US012454783B2

(12) United States Patent
Hammond et al.

(10) Patent No.: US 12,454,783 B2
(45) Date of Patent: Oct. 28, 2025

(54) LAUNDRY TREATING APPLIANCE AND METHOD OF OPERATION

(71) Applicant: WHIRLPOOL CORPORATION, Benton Harbor, MI (US)

(72) Inventors: Richard L. Hammond, Mattawan, MI (US); David Adrian Moelker, Zeeland, MI (US); Luke John Paul, Jenison, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 79 days.

(21) Appl. No.: 18/541,861

(22) Filed: Dec. 15, 2023

(65) Prior Publication Data

US 2024/0125033 A1 Apr. 18, 2024

Related U.S. Application Data

(62) Division of application No. 16/828,552, filed on Mar. 24, 2020, now Pat. No. 11,885,058.

(60) Provisional application No. 62/835,740, filed on Apr. 18, 2019.

(51) Int. Cl.

| | |
|---|---|
| ***D06F 34/18*** | (2020.01) |
| ***D06F 33/44*** | (2020.01) |
| ***D06F 93/00*** | (2006.01) |
| *D06F 103/02* | (2020.01) |
| *D06F 105/56* | (2020.01) |

(52) U.S. Cl.

CPC ..... *D06F 34/18* (2020.02); *D06F 33/44* (2020.02); *D06F 93/005* (2013.01); *D06F 2103/02* (2020.02); *D06F 2105/56* (2020.02)

(58) Field of Classification Search

CPC ..... D06F 34/18

See application file for complete search history.

(56) References Cited

U.S. PATENT DOCUMENTS

| | | | |
|---|---|---|---|
| 8,325,019 | B2 | 12/2012 | Liu et al. |
| 2007/0261713 | A1 | 11/2007 | Choi et al. |
| 2014/0167920 | A1 | 6/2014 | Kamiya |
| 2017/0241066 | A1 | 8/2017 | Caspers |
| 2019/0050613 | A1 | 2/2019 | Wilkinson et al. |

FOREIGN PATENT DOCUMENTS

| | | | |
|---|---|---|---|
| CN | 1961111 | A | 5/2007 |
| CN | 102747584 | A | 10/2012 |
| CN | 105401382 | A | 3/2016 |

(Continued)

OTHER PUBLICATIONS

Decision To Grant for Counterpart CN202010299266.6, Dated Jul. 16, 2023, 8 Pages.

(Continued)

*Primary Examiner* — Jason Y Ko

(74) *Attorney, Agent, or Firm* — McGarry Bair PC

(57) ABSTRACT

A laundry treating appliance for treating laundry items according to a cycle of operation includes a chassis defining an interior. A rotatable treating chamber is located within the interior. An antenna is configured to receive RFID data from RFID tags on the laundry items and outputs a signal indicative of the RFID data. A controller receives the signal from the antenna and is configured to process the signal and to suggest, alter, or implement the cycle of operation based on the signal.

10 Claims, 5 Drawing Sheets

(56) References Cited

FOREIGN PATENT DOCUMENTS

| | | | |
|---|---|---|---|
| CN | 206470804 | U | 9/2017 |
| CN | 208151708 | U | 11/2018 |
| CN | 109468796 | A | 3/2019 |
| DE | 102012215431 | A1 | 3/2014 |
| EP | 1225267 | A1 | 7/2002 |
| EP | 2568077 | A1 | 3/2013 |
| EP | 2527517 | B1 | 4/2016 |
| EP | 3196349 | A1 | 7/2017 |
| IN | 2012DE02059 | | 1/2014 |
| JP | 2016181813 | A | 10/2016 |
| JP | 2018138127 | A | 9/2018 |
| KR | 20090076722 | A | 7/2009 |
| KR | 20190004436 | A | 1/2019 |
| WO | 2018040939 | A1 | 3/2018 |

OTHER PUBLICATIONS

European Search Report for Counterpart EP20167858.8, Dated Sep. 15, 2020.

LAUNDRY TREATING APPLIANCE AND METHOD OF OPERATION

CROSS-REFERENCE TO RELATED APPLICATIONS

This application is a divisional application of and claims the benefit of U.S. patent application Ser. No. 16/828,552, filed on Mar. 24, 2020, now U.S. Pat. No. 11,885,058, issued Jan. 30, 2024, which claims the benefit of U.S. Provisional Patent Application No. 62/835,740, filed on Apr. 18, 2019, both of which are incorporated herein by reference in their entirety.

BACKGROUND

Laundry treating appliances, such as washing machines, refreshers, and non-aqueous systems, can have a configuration based on a container, which may or may not rotate, that at least partially defines a treating chamber in which laundry items are placed for treating. The laundry treating appliance can have a controller that implements a number of user-selectable, pre-programmed cycles of operation. Hot water, cold water, or a mixture thereof along with various treating chemistries, or detergents, can be supplied to the treating chamber in accordance with the cycle of operation.

Laundry treating appliances typically operate to treat laundry items by placing the laundry items in contact with treating fluid such as a detergent/water mixture, sometimes referred to as wash liquor, and providing relative motion between the laundry items and the fluid. A laundry treating appliance for home use can perform a select programmed series of operations on fabric placed in a tub, basket, or drum located within the interior of the machine, including providing the water to the laundry items at a desired or predetermined temperature. In some instances, the laundry treating appliance can be configured to automatically detect a laundry load in order to suggest or select a desired cycle of operation, including, for example, water temperature, spin speed, and wash speed.

Radio-frequency identification (RFID) technology can be utilized for identifying laundry items in order to suggest or select a cycle of operation for the laundry treating appliance. For example, RFID inlays or tags can be encoded or incorporated with laundry items to identify each laundry item to be treated. The laundry treating appliance can include an antenna to receive RFID information from the laundry items and optimize the cycle of operation accordingly.

BRIEF DESCRIPTION

In another aspect, the present disclosure relates to a method for operating a laundry treating appliance for treating laundry items according to a cycle of operation, the method comprising rotating a rotatable treating chamber containing laundry items having RFID tags, receiving, by an antenna, RFID data from the RFID tags on the laundry items, processing, by a controller communicably coupled with the antenna, the RFID data to distinguish between RFID tags that are moving and RFID tags that are stationary, ignoring RFID data from the stationary RFID tags, and suggesting, altering, or implementing the cycle of operation based on the RFID data from the moving RFID tags.

DETAILED DESCRIPTION

Figure 1:
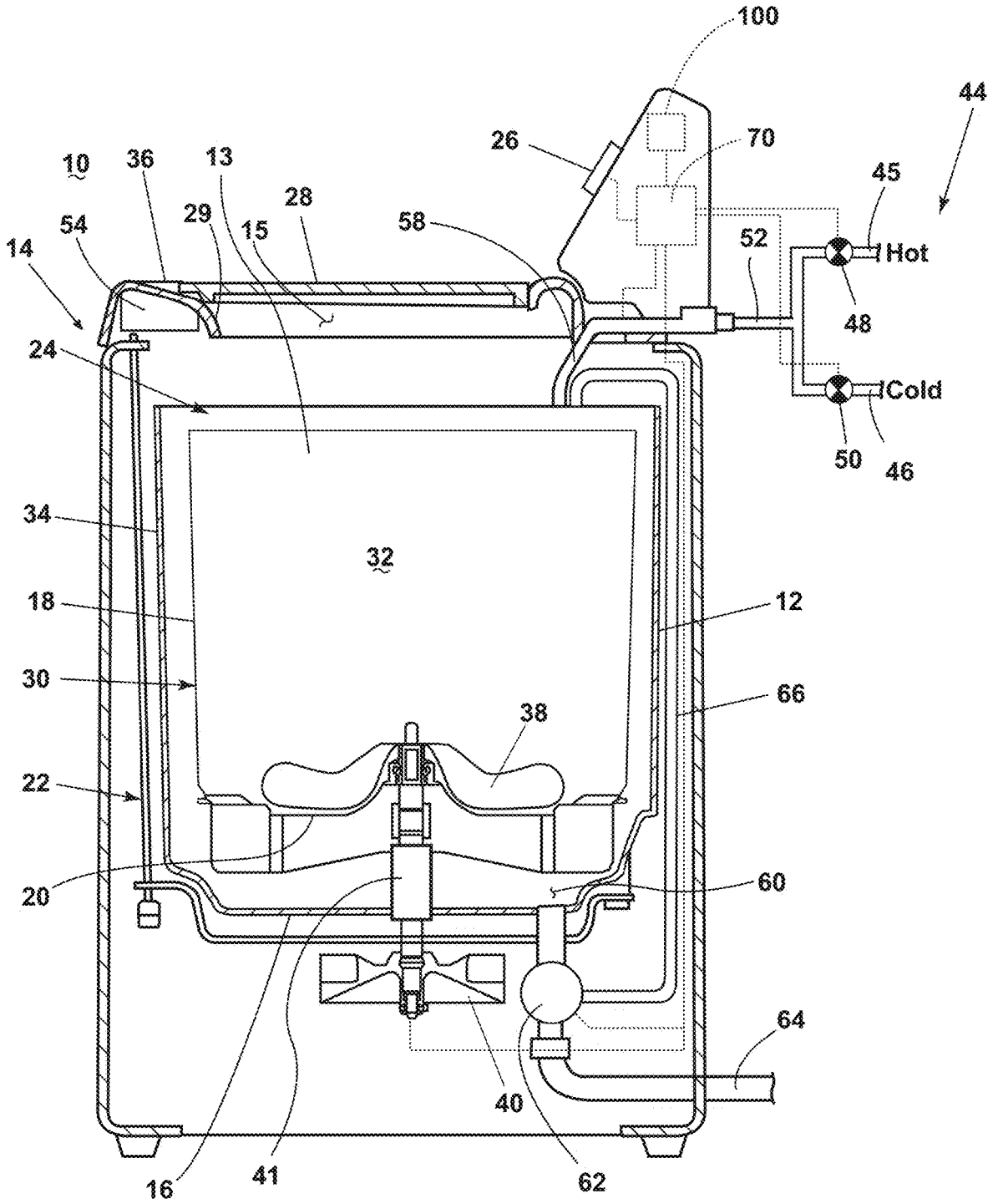
FIG. 1 is a schematic cross-sectional view of a laundry treating appliance in the form of a washing machine including an antenna.

FIG. 1 is a schematic view of a laundry treating appliance according to aspects of the present disclosure. The laundry treating appliance can be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance of FIG. 1 is illustrated as a vertical axis, top-load laundry treating appliance, the aspects of the present disclosure can have applicability in laundry treating appliances with other configurations.

Washing machines are typically categorized as either a vertical axis washing machine or a horizontal axis washing machine. As used herein, the term "horizontal axis" washing machine refers to a washing machine having a rotatable drum that rotates about a generally horizontal axis relative to a surface that supports the washing machine. The drum can rotate about the axis inclined relative to the horizontal axis, with fifteen degrees of inclination being one example of the inclination. Similar to the horizontal axis washing machine, the term "vertical axis" washing machine refers to a washing machine having a rotatable drum that rotates about a generally vertical axis relative to a surface that supports the washing machine. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The laundry treating appliance of FIG. 1 is illustrated as a vertical-axis washing machine 10, which can include a structural support system including a cabinet 14, which defines a housing within which a laundry holding system resides. The cabinet 14 can be a housing having a chassis and/or a frame, to which decorative panels can or cannot be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system of the illustrated exemplary washing machine 10 can include a rotatable basket 30 having an open top 13 that can be disposed within the interior of the cabinet 14 and can define a rotatable treating chamber 32 for receiving laundry items for treatment and an access opening 15. The basket 30 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The open top can be aligned with the access opening 15. A tub 34 can also be positioned within the cabinet 14 and can define an interior 24 within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations, such that liquid can flow between the tub 34 and the rotatable basket 30 through the perforations. While the illustrated washing machine 10 includes both the tub 34 and the basket 30, with the basket 30 defining the treating chamber 32, it is within the scope of the present disclosure for the laundry treating appliance to include only one receptacle, with the receptacle defining the laundry treatment chamber for receiving the load to be treated.

The cabinet 14 can further define a top wall 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34. A selectively openable cover, illustrated herein as comprising a lid 28 can be movably mounted to the cabinet 14 for selective movement between an opened position and a closed position to selectively open and close the access opening 15, respectively, and to provide access into the laundry treating chamber 32 through the access opening 15 of the basket 30.

A laundry mover 38 can be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the laundry mover 38 can be driven by a drive system 40 that includes a motor 41, which can include a gear case, operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can be included to provide liquid, such as water or a combination of water and one or more wash aids, such as detergent, into the treating chamber 32. The liquid supply system can include a water supply 44 configured to supply hot or cold water. The water supply 44 can include a hot water inlet 45 and a cold water inlet 46. A valve assembly can include a hot water valve 48, a cold water valve 50, and various conduits 52, 58 for selectively distributing the water supply 44 from the hot water and cold water inlets 45, 46. The valves 48, 50 are selectively openable to provide water, such as from a household water supply (not shown) to the conduit 52. A second water conduit, illustrated as the water inlet 58, can also be fluidly coupled with the conduit 52 such that water can be supplied directly to the treating chamber 32 through the open top of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e. a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30, either directly or mixed with water from the water supply 44. The treating chemistry dispenser 54 can be a single use dispenser, a bulk dispenser, or a combination of a single use and bulk dispenser in non-limiting examples, and is fluidly coupled to the treating chamber 32. While the treating chemistry dispenser 54 is illustrated herein as being provided at the top wall 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e. a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply system and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, the sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, recirculation and drain system are shown for exemplary purposes only and are not limited to the systems shown in the drawings and described above. For example, the liquid supply, recirculation and pump systems can differ from the configuration shown in FIG. 1, such as by inclusion of other valves, conduits, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump 60. Alternatively, the heating system can be in the form of an in-line heater that heats the liquid as it flows through the liquid supply, dispensing and/or recirculation systems.

The washing machine 10 can further include a control system, illustrated herein as a controller 70, which can be thought of as a laundry treating appliance controller 70, coupled with various working components of the washing machine 10 to control the operation of the working components and to implement one or more treating cycles of operation. An antenna 100 can be communicably coupled with the controller 70. The antenna 100 can provide an input function for the controller 70 and can receive control information from the controller 70. The antenna 100 can be configured to receive RFID data and to provide the RFID data to the controller 70. A user interface 26 can be operably coupled with the controller 70. The user interface 26 can provide an input and output function for the controller 70. The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the washing machine 10 and can allow the controller 70 to communicate with the user in a variety of ways. For example, the controller 70 can be configured to send a text message to the user, send an electronic mail to the user, or provide audio information to the user either through the washing machine 10 or utilizing another device such as a mobile phone.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
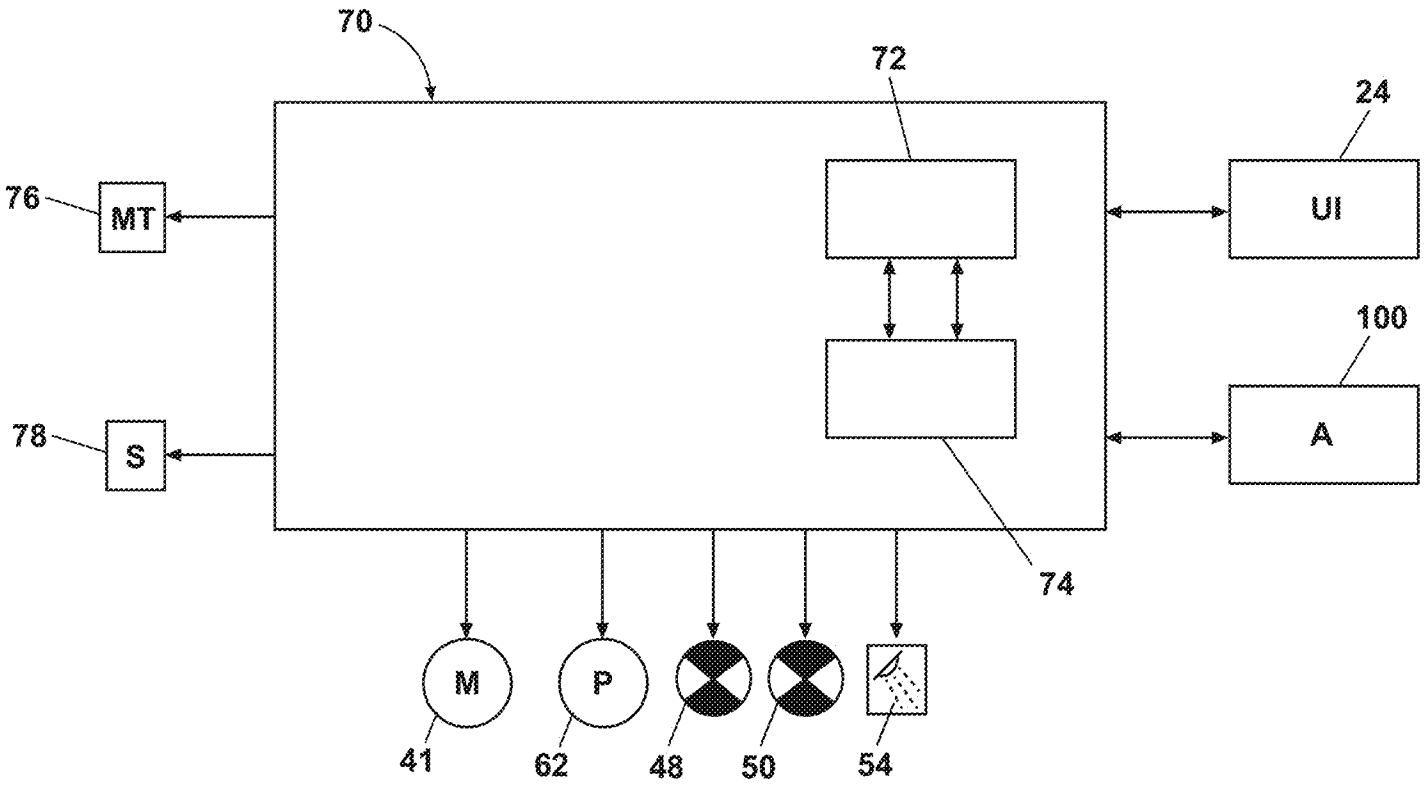
FIG. 2 is a schematic representation of a control system for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. For example, the memory 72 can store a set of executable instructions including at least one user-selectable cycle of operation. Examples, without limitation, of treating cycles of operation include: wash, heavy-duty wash, delicate wash, quick wash, pre-wash, refresh, rinse only, and timed wash, which can be selected at the user interface 26. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, and the dispenser 54 for controlling the temperature and flow rate of treating liquid into the treating chamber 32; the pump 62 for controlling the amount of treating liquid in the treating chamber 32 or sump 60; drive system 40 at the motor 41 for controlling the direction and speed of rotation of the basket 30 and/or the clothes mover 38; the user interface 26 for receiving user selected inputs and communicating information to the user; and the antenna 100 for receiving RFID data and controlling the operation of the antenna 100. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include a weight sensor, a moisture sensor, a chemical sensor, a position sensor, an imbalance sensor, a load size sensor, and a motor torque sensor, which can be used to determine a variety of system and laundry characteristics, such as laundry load inertia or mass.

Figure 3:
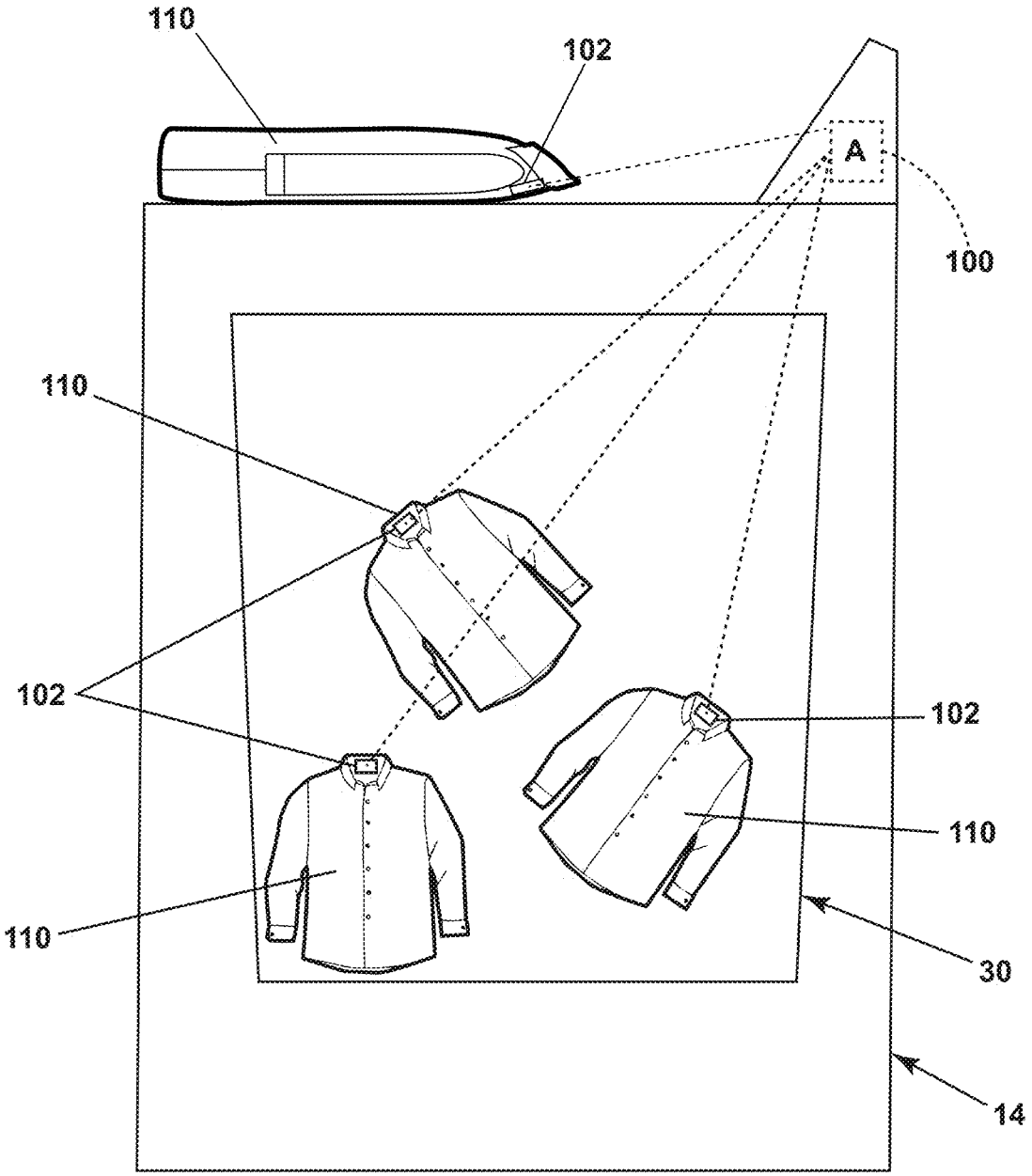
FIG. 3 is a schematic view of an RFID system for use with the laundry treating appliance of FIG. 1, including the antenna and exemplary laundry items having RFID tags.

Turning now to FIG. 3, a schematic view of an RFID communication system for use within the washing machine 10 and including the antenna 100 is shown. The antenna 100 can be configured to receive and read data from an RFID tag 102 that can be provided with a laundry item 110. The antenna 100 can be any suitable antenna for receiving information from tags 102 on laundry items 110. In one non-limiting example, the antenna 100 can be provided as an RFID reader. The RFID reader can be any suitable RFID reader, non-limiting examples of which include an ultra high frequency (UHF) RFID reader, a 900 MHz RFID reader, a 13 MHz RFID reader, a 2.4 GHz RFID reader, etc. While the antenna 100 has been illustrated herein as communicably coupled with the controller 70, such as by a communications bus or other suitable means of communication, it will also be understood that the antenna 100 can be integrated with the controller 70 such that the controller 70 acts as an antenna controller 70, or the antenna 100 can include its own controller that is communicably coupled to the controller 70 of the washing machine 10. By way of non-limiting example, the antenna 100 and/or the controller 70 can be configured to communicate with the cloud, such that the cloud can act as the controller for the antenna 100 and can in turn be communicably coupled to the controller 70, or the controller 70 can provide information from the antenna 100 to the cloud, as well as receive information or instruction back from the cloud.

The RFID tags 102 on the laundry items 110 that can be read by the antenna 100 can be provided at any location on the laundry items 110 and can be coupled to the laundry items 110, either removably or non-removably, by the manufacturer of the laundry item 110, or can be attached to the laundry item 110 by a user. By way of non-limiting example, the RFID tag 102 can be embedded in a laundry item 110, such as a clothing item, can be sewn into a laundry item 110, pinned to a laundry item 110, or otherwise coupled. For example, in a commercial laundry setting, it is known that laundry items 110 can include RFID tags 102 in order to identify the ownership of the laundry items 110 and to easily sort out the laundry items 110 to be returned to the appropriate user after treating.

Radio-frequency identification can be accomplished over a variety of frequencies and with a variety of communication protocols. For example, near-field communication (NFC) can enable devices within close proximity to each other (for example, within 5 cm) to establish communication. Other standards include industrial, scientific, and medical (ISM) bands such as 13 MHz, or ultra-wide-band communication such as 4 GHz. RFID tags can have a range of physical sizes, such as 0.05 mm to 5 cm or larger, and configurations such as active, passive, or battery-assisted passive, for use in the various frequency bands and communication protocols.

The data transmitted from the RFID tag 102 to the antenna 100 can include a variety of identification information relating to the laundry item 110, non-limiting examples of which can include a globally unique identifier, color, fabric type, recommended water temperature and/or cycle of operation for washing, or recommended air temperature and/or cycle of operation for drying. The data received from the RFID tags 102 by the antenna 100 can then be transmitted to, via wired or wireless communication, the controller 70 where the data can be analyzed in order to determine, identify, or characterize the contents of a laundry load.

Figure 4:
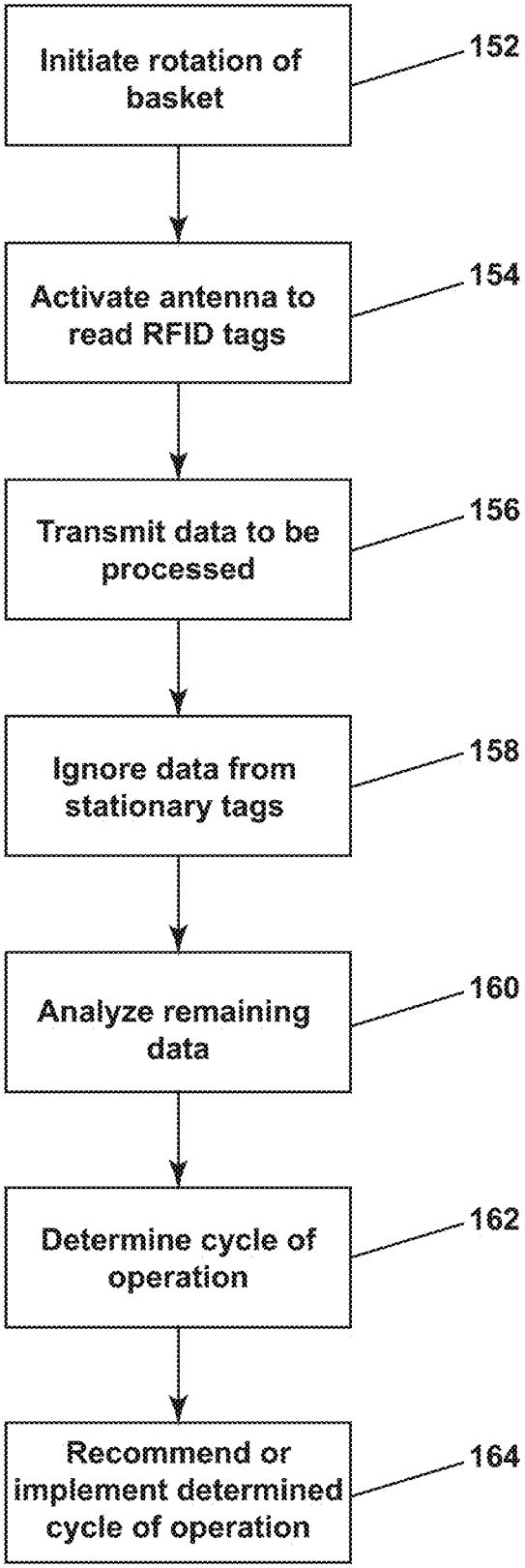
FIG. 4 is a flowchart illustrating a method of operating the laundry treating appliance of FIG. 1, including processing RFID data received by the antenna from the RFID tags of the laundry items.

FIG. 4 is a flowchart illustrating a method of operating the laundry machine 10 and the antenna 100. One challenge in using an RFID reader or antenna 100 in the washing machine 10 is that laundry items 110 having RFID tags 102 that may be near the washing machine 10 but outside of the washing machine 10 can still be read by the antenna 100 and taken into account in selecting the cycle of operation and identifying laundry items 110, even though those laundry items 110 are not, in fact, part of the laundry load placed within the treating chamber 32. The method of FIG. 4 overcomes this challenge to ensure that only data from RFID tags 102 of laundry items 110 that are actually placed within the treating chamber 32 is used in the cycle selection and recommendation processes of the washing machine 10.

At step 152, prior to the supply of water to the treating chamber 32, the controller 70 can drive the drive system 40 and motor 41 to rotate the basket 30. During this rotation of the basket 30, detection of the laundry load and laundry items 110 can be performed. Load detection can include a variety of parameters relating to the laundry load received in the treating chamber 32, non-limiting examples of which include a weight of the laundry load or a size of the laundry load. The rotation of the basket 30 can be continuous throughout the laundry load detection at a constant speed, continuous throughout the laundry load detection at a varying speed, including a steadily or variably increasing speed, or can include at least one rotation at multiple dwell speeds or rotation that is stopped and re-started at least once. This rotation, prior to the supply of water to the treating chamber 32, can occur after the selection and initiation of a cycle of operation and can provide feedback to the selection of the cycle of operation based on the load detection. It is also contemplated that the rotation can be initiated without the selection and initiation of a cycle of operation and that the selection of the cycle of operation can occur after and based upon the load detection.

At step 154, the controller 70 can activate the antenna 100 to receive and read RFID data from RFID tags 102 within range of the antenna 100. The receiving of RFID data by the antenna 100 can occur during the rotation of the basket 30 as described with respect to step 152. The receiving of the RFID data during the rotation of the basket 30 can occur before water is supplied to the treating chamber 32. The receiving of the RFID data from the RFID tags 102 can include receiving RFID data from RFID tags 102 on laundry items 110 that may be outside the treating chamber 32 and the washing machine 10. The reading of the RFID data from the RFID tags 102 of all the laundry items 110 can be completed in as little as a few seconds. While the receiving of RFID data from the RFID tags 102 has been described herein as occurring during laundry load detection, it will be understood that the reading of RFID data by the antenna 100 can also occur before or after laundry load detection, or any combination of before, during, and after laundry load detection.

At step 156, the RFID data received by the antenna 100 can be transmitted to the controller 70 or to the cloud, either via wired transmission such as by the communications bus, or by wireless transmission. It will also be understood that the antenna 100 can include its own controller, which can be the cloud, to which the RFID data can be provided prior to providing an input to the controller 70 of the washing machine 10.

At step 158, the controller 70, or the cloud, can operate to and is configured to ignore, to remove, or to filter out data from RFID tags 102 on laundry items 110 that are outside the treating chamber 32 from the complete set of RFID data received by the antenna 100. Because the receiving of the RFID data by the antenna 100 is conducted when the basket 30 is rotating, only RFID data received from RFID tags 102 that are moving represent laundry items 110 located within the treating chamber 32. Thus, by ignoring, removing, or filtering the RFID data from RFID tags 102 that are stationary during the rotation of the basket 30, it can be ensured that the data used to detect and identify the laundry load and laundry items 110 therein is based solely on laundry items 110 that are within the treating chamber 32.

Figure 5:
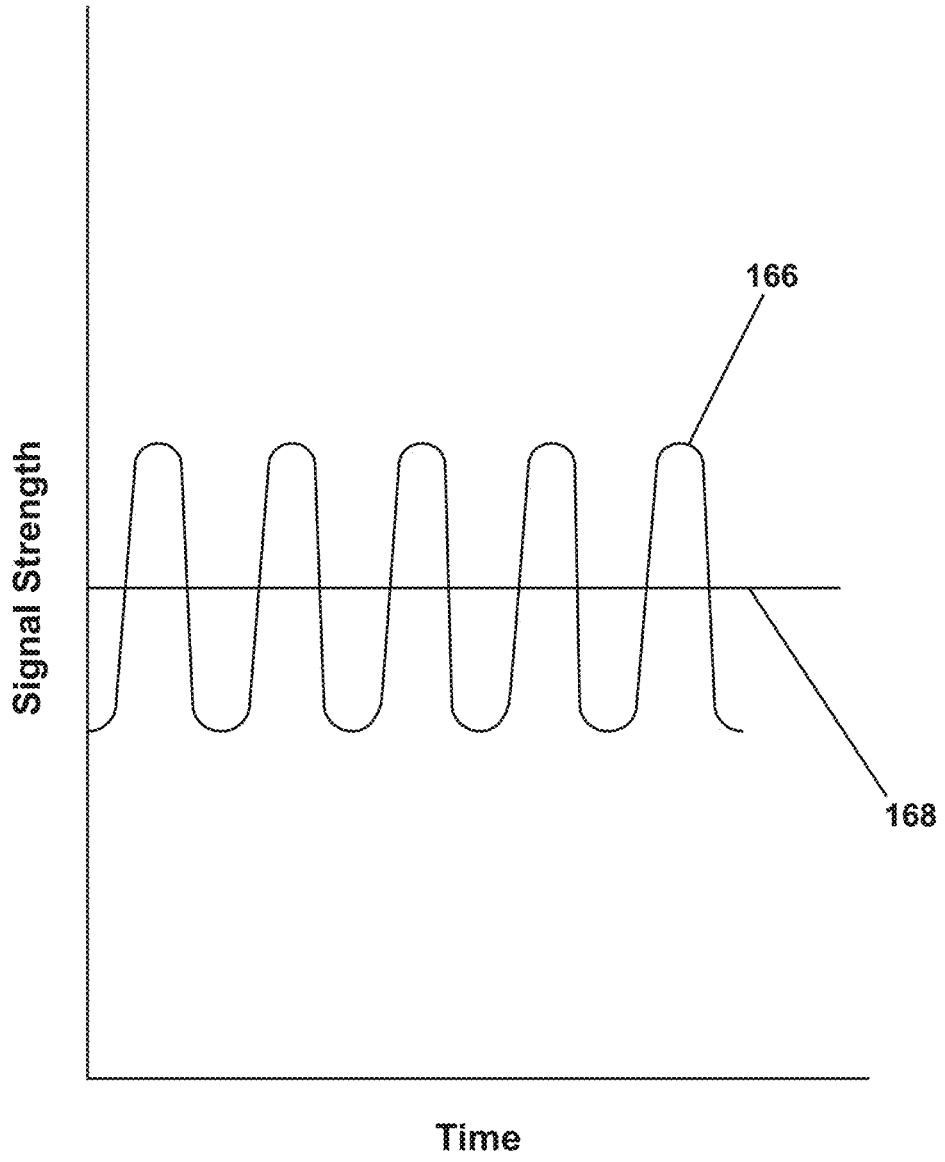
FIG. 5 is a chart illustrating signal strength measurements that can be used in the processing the RFID data of FIG. 4.

Determination of which RFID data should be ignored, removed, or filtered by the controller 70 or by the cloud can be accomplished by signal processing, such as by analyzing signal strength, as described further in FIG. 5, and/or by using the expected motion of the rotation of the basket 30 to determine which RFID tags 102 are moving. This can identify the portion of the RFID data being received from RFID tags 102 that are located within the treating chamber 32 from the entire population of RFID data from the RFID tags 102 within detection range of the antenna 100. The controller 70 or the cloud can be equipped with a software configured to conduct such signal processing, though it will be understood that the software can instead be installed with the antenna 100 itself, rather than in the controller 70. Any suitable method of signal processing can be used to determine which of the RFID tags 102 are moving within the rotating basket 30 and which are not, non-limiting examples which can include at least one of signal strength analysis, signal phase analysis, signal amplitude changes and analysis, frequency analysis, transformed frequency analysis, standard deviation metrics, or short time Fourier transformations.

At step 160, after the RFID data from the stationary RFID tags 102 has been ignored, removed, or filtered out by the controller 70 or the cloud, the remaining RFID data, which corresponds only to laundry items 110 located within the treating chamber 32 can be further analyzed. By way of non-limiting example, the colors of the laundry items 110, fabric types, or recommended washing or drying temperature can be analyzed to determine an overall characteristic or profile of the laundry load.

At step 162, the analyzed data for the laundry items 110 located within the treating chamber 32 can be used by the controller 70 or the cloud to make a determination of a cycle of operation to be used for treating the laundry load. The determined cycle of operation to be used could be the same as or different from the cycle of operation which may have already been selected prior to the determination. By way of non-limiting example, the controller 70 or the cloud can determine a temperature for liquid to be supplied to the treating chamber 32, a temperature for drying air, or a cycle type, such as delicate, hand wash, normal wash, or heavy duty wash, that is optimal for the detected laundry load based on the RFID data received from the RFID tags 102. In one example, the controller 70 or the cloud can include or can be communicably coupled with a database, such as a look-up table, in order to make these determinations based on the RFID data received from the RFID tags 102. In addition, the controller 70 or the cloud can identify when a non-compatible laundry item 110 may be present in the treating chamber 32, such as a red laundry item 110 present in a laundry load otherwise consisting of white laundry items 110. The software of the controller 70 or the cloud can be programmed or configured to identify types of cycles to be recommended and to identify clothing conflicts such as non-compatible laundry items 110. In the case that a non-compatible laundry item 110 is detected, the controller 70, either on its own or under direction from the cloud, can notify the user and/or default to a cycle of operation selected to prevent or inhibit dye transfer.

At step 164, the determination of the optimal cycle of operation can be acted upon. In one example, the recommended cycle of operation can be automatically implemented by the controller 70 and the washing machine 10, regardless of whether the recommended cycle of operation differs from a pre-selected cycle of operation, and treatment of the laundry load can begin automatically once the controller 70 selects the cycle of operation. In another example, the recommended cycle of operation can be presented to a user rather than being automatically implemented, such as by being presented on the user interface 26, or by being presented to the user via a connected other appliance or on an electronic device, such as an application on a smartphone, tablet, or computer. In the case that the user is prompted to take action, such as to approve or select the suggested cycle of operation, whether or not the recommended cycle of operation differs from a pre-selected cycle of operation, such a prompt can be provided to the user within a short amount of time after the user starts the washing machine 10, such as 30 seconds. The controller 70 can require approval from the user prior to implementation of the recommended cycle of operation, or the controller 70 can be configured to automatically implement the recommended cycle of operation if no input is received from the user within a predetermined period of time after the recommendation is presented to the user. The user can select a setting indicating if receipt of a prompt is desired, if the recommended cycle of operation should be automatically implemented, or if a default cycle should always be implemented if the user response to the prompt is not received, such as to always wash on a delicate cycle of operation in cold water if no input is received.

FIG. 5 is a chart illustrating further how the signal strength can be analyzed in order to identify the portion of the RFID data received from stationary RFID tags 102 that should be removed from the RFID data to be further analyzed. If a laundry item 110 is located within the treating chamber 32, the laundry item 110 will move within the treating chamber 32 as the basket 30 rotates, causing the distance between the RFID tag 102 and the antenna 100 to vary over time as the basket 30 rotates. As the distance and/or polarization between the RFID tag 102 and the antenna 100 varies, the strength of the signal received by the antenna 100 from said moving RFID tag 102 will also vary. In one example, such rotating movement of the basket 30 will cause a signal that varies repeatedly between a high point and a low point, as represented by the curve 166. If a laundry item 110 is stationary, the distance between the RFID tag 102 and the antenna 100 will stay constant, and will result in a constant and unchanging strength of signal received from the stationary RFID tag 102, as represented by the line 168. Based upon this, the controller 70 and the software can filter out RFID data from RFID tags 102 having constant signal strength because those RFID tags 102 correspond to laundry items 110 outside of the treating chamber 32.

The aspects of the present disclosure provide for a method of receiving RFID data from RFID tags coupled with laundry items in order to identify laundry items and determine an optimal cycle of operation by which the laundry items present in the laundry load can be treated within a washing machine. The method disclosed herein ensures that only the RFID data from laundry items located within the treating chamber are used in making such a determination, without requiring the user to manually scan RFID tags as laundry items are added to the treating chamber and without requiring costly shielding materials and structures to be incorporated with the washing machine in order to prevent the reading of RFID tags located outside of the treating chamber by the antenna. Instead, RFID data from laundry items located outside of the treating chamber can be quickly removed by signal processing to remove data from RFID tags that are not moving when the basket is rotated.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

While the aspects of the present disclosure have been specifically described in connection with certain specific aspects thereof, it is to be understood that this is by way of illustration and not of limitation. Reasonable variation and modification are possible within the scope of the forgoing disclosure and drawings without departing from the spirit of the present disclosure which is defined in the claims. Hence, specific dimensions and other physical characteristics relating to the aspects of the present disclosure are not to be considered as limiting, unless expressly stated otherwise.

What is claimed is:

1. A method of operating a laundry treating appliance for treating laundry items according to a cycle of operation, the method comprising:

rotating a rotatable treating chamber containing laundry items having RFID tags;

receiving, by an antenna, RFID data from the RFID tags on the laundry items;

processing, by a controller communicably coupled with the antenna, the RFID data to distinguish between RFID tags that are moving and RFID tags that are stationary;

ignoring RFID data from the stationary RFID tags; and suggesting, altering, or implementing the cycle of operation based on the RFID data from the moving RFID tags.

2. The method of claim 1 wherein the receiving the RFID data by the antenna occurs during the rotation of the rotatable treating chamber.

3. The method of claim 2 wherein the rotation of the rotatable treating chamber and the receiving the RFID data by the antenna occurs prior to supplying water to the treating chamber.

4. The method of claim 1 wherein the antenna is an RFID reader.

5. The method of claim 1 wherein the controller is an antenna controller and is integrated with the antenna.

6. The method of claim 5 wherein the antenna controller is communicably coupled with a laundry treating appliance controller.

7. The method of claim 1 wherein distinguishing between the moving RFID tags and the stationary RFID tags comprises signal processing of the RFID data.

8. The method of claim 7 wherein the signal processing of the RFID data comprises analyzing signal strength.

9. The method of claim 7 wherein the signal processing of the RFID data comprises at least one of signal strength analysis, signal phase analysis, signal amplitude change analysis, frequency analysis, transformed frequency analysis, standard deviation metrics, or short time Fourier transformations.

10. The method of claim 1 wherein the RFID tags are removably or non-removably coupled to the laundry items.

* * * * *